US006295366B1

(12) United States Patent
Haller et al.

(10) Patent No.: US 6,295,366 B1
(45) Date of Patent: Sep. 25, 2001

(54) AIRCRAFT HEADSET

(75) Inventors: Larry D. Haller, Hillsboro; Charles E. Inmon, Lake Oswego; Christopher J. Jensen, Hillsboro; James D. Pileggi, Beaverton; Brian VanderPloeg, Lake Oswego; Stevan L. Wittenbrock, Portland, all of OR (US)

(73) Assignee: Flightcom Corporation, Portland, OR (US)

( * ) Notice: Subject to any disclaimer, the term of this patent is extended or adjusted under 35 U.S.C. 154(b) by 0 days.

(21) Appl. No.: 09/275,513

(22) Filed: Mar. 24, 1999

(51) Int. Cl.[7] ..... H04R 25/00

(52) U.S. Cl. ..... 381/374; 381/370; 381/371; 381/375; 381/376; 381/378; 381/379; 379/430

(58) Field of Search ..... 381/370, 371, 381/372, 375, 376, 377, 378, 379, FOR 149, FOR 150; 181/128, 129, 137; 379/430; 455/90

(56) References Cited

U.S. PATENT DOCUMENTS

| | | | | |
|---|---|---|---|---|
| D. 322,440 | | 12/1991 | Urella . | |
| D. 377,174 | | 1/1997 | Runquist . | |
| 2,603,724 | * | 7/1952 | Kettler | 381/372 |
| 4,571,746 | * | 2/1986 | Gorike | 381/370 |
| 4,922,542 | | 5/1990 | Sapiejewski . | |
| 4,975,966 | | 12/1990 | Sapiejewski . | |
| 4,987,592 | * | 1/1991 | Flagg | 381/375 |
| 4,989,271 | | 2/1991 | Sapiejewski et al. . | |
| 5,095,382 | * | 3/1992 | Abe | 381/378 |
| 5,185,807 | * | 2/1993 | Bergin et al. | 381/374 |
| 5,708,725 | * | 1/1998 | Ito | 381/370 |
| 5,793,878 | * | 8/1998 | Chang | 381/370 |
| 5,862,241 | * | 1/1999 | Nelson | 381/371 |
| 5,970,160 | * | 10/1999 | Nilsson et al. | 381/370 |

OTHER PUBLICATIONS

New Headphone For Every Head, Nov. 1980.*
Only Sony Offers the Most Advanced Headsets for Every Mindset, Nov. 1980.*

* cited by examiner

*Primary Examiner*—Curtis Kuntz
*Assistant Examiner*—Suhan Ni
(74) *Attorney, Agent, or Firm*—Robert D. Varitz, PC

(57) ABSTRACT

An aircraft headset includes a headset band, including a head element and a pair of ear cup supports slidably received in the head element, ear cups pivotally attached at one end of each ear cup support; and a microphone boom pivotally attached to one of the ear cups; an improved ear cup tensioning mechanism including a tongue extending laterally from each end of the headset band and a conformal tongue receiver located adjacent the other end of each ear cup support; wherein the tongue receiver is conformal with the tongue, and wherein the tongue and the tongue receiver are constructed and arranged to provide near-constant lateral pressure between the ear cups and a wearer's head. An improved ear cup seal includes an outer seal covering formed of urethane-coated expanded vinyl; an inner flexible layer formed of scythed urethane foam; wherein the inner flexible layer has a memory which returns the ear seal to its original configuration when pressure is released therefrom, and wherein the ear cup seal has a variable configuration having its thickest region behind and below a wearer's ear, along the wearer's neck, and having its thinnest region adjacent the front of the wearer's ear along the jaw line. An improved microphone housing includes a hard outer shell having a cavity therein; and sound-absorbing material located inside the outer shell which enclose the microphone element.

8 Claims, 5 Drawing Sheets

AIRCRAFT HEADSET

FIELD OF THE INVENTION

This invention relates to headsets intended primarily for use in aircraft, and specifically to a headset that provides extended wear comfort and provides enhanced background noise reduction.

BACKGROUND OF THE INVENTION

Headsets generally include a headband that incorporates, or is made from, a spring, which passes over the head of the user and presses the ear cups to the wearer's head with some predetermined force. Some mechanism is provided to allow the length of the headband to change, such as providing a headband element having a hollow cavity therein, which cavity receives sliding elements, which are attached to the ear cups. The headband also provides vertical support to keep the ear cups from slipping off the wearer's ears under the influence of gravity or other G forces.

The tension supplied by the headband is in the form of a bending moment transmitted along the components of the headband. If the material of the headband, the stress, and bending moment are nearly constant, the only variables which remain are the width and thickness of the band. However, as the headset is adjusted for different wearers, or as a single wearer changes the location of the headset on the wearer's head, the moment changes, as the distance between the headband element and the ear cup changes. While it is desirable to provide a constant, evenly disbursed headband-generated force on the ear cups, changing the bending moment of the headband changes the lateral force applied by the headband in prior art systems.

Another feature of aircraft headsets is noise reduction so that a headset wearer (1) can hear sound generated by transducers in the ear cups over the aircraft background noise, which is accomplished by providing an acoustic seal between the wearer's head and the ear cup; and (2) generate a signal from a microphone, usually attached to one of the ear cups, wherein the background noise from the aircraft is minimized by the microphone pickup. The present invention embodies an improved headphone ear seal that further improves comfort while providing a good Prior art cushions have incorporated a variety of non-liquid gelatin-like material on a ring of soft, slow recovery foam enclosed within a thin stretchable layer of polyurethane skin. A variety of configurations have been used, including multiple rings of cushioning, various thicknesses and durometer ratings of material, etc. The known prior art has presented cushions of uniform cross-section, while failing to consider the shape of the human head.

Likewise, microphone pickups have used a variety of dampening materials to eliminate pickup of vibrations from the headset and to reduce wind and pop noises. These systems have generally placed sound-dampening materials outside the microphone housing, and have proven less than adequate.

SUMMARY OF THE INVENTION

An aircraft headset includes a headset band, including a head element and a pair of ear cup supports slidably received in the head element, ear cups pivotally attached at one end of each ear cup support; and a microphone boom pivotally attached to one of the ear cups; an improved ear cup tensioning mechanism including a tongue extending laterally from each end of the headset band and a conformal tongue receiver located adjacent the other end of each ear cup support; wherein the tongue receiver is conformal with the tongue, and wherein the tongue and the tongue receiver are constructed and arranged to provide near-constant lateral pressure between the ear cups and a wearer's head. An improved ear cup seal includes an outer seal covering formed of urethane-coated expanded vinyl; an inner flexible layer formed of scythed urethane foam; wherein the inner flexible layer has a memory which returns the ear seal to its original configuration when pressure is released therefrom, and wherein the ear cup seal has a variable configuration having its thickest region behind and below a wearer's ear, along the wearer's neck, and having its thinnest region adjacent the front of the wearer's ear along the jaw line. An improved microphone housing includes a hard outer shell having a cavity therein; and sound-absorbing material located inside the outer shell which enclose the microphone element.

DETAILED DESCRIPTION OF THE PREFERRED EMBODIMENT

Figure 1:
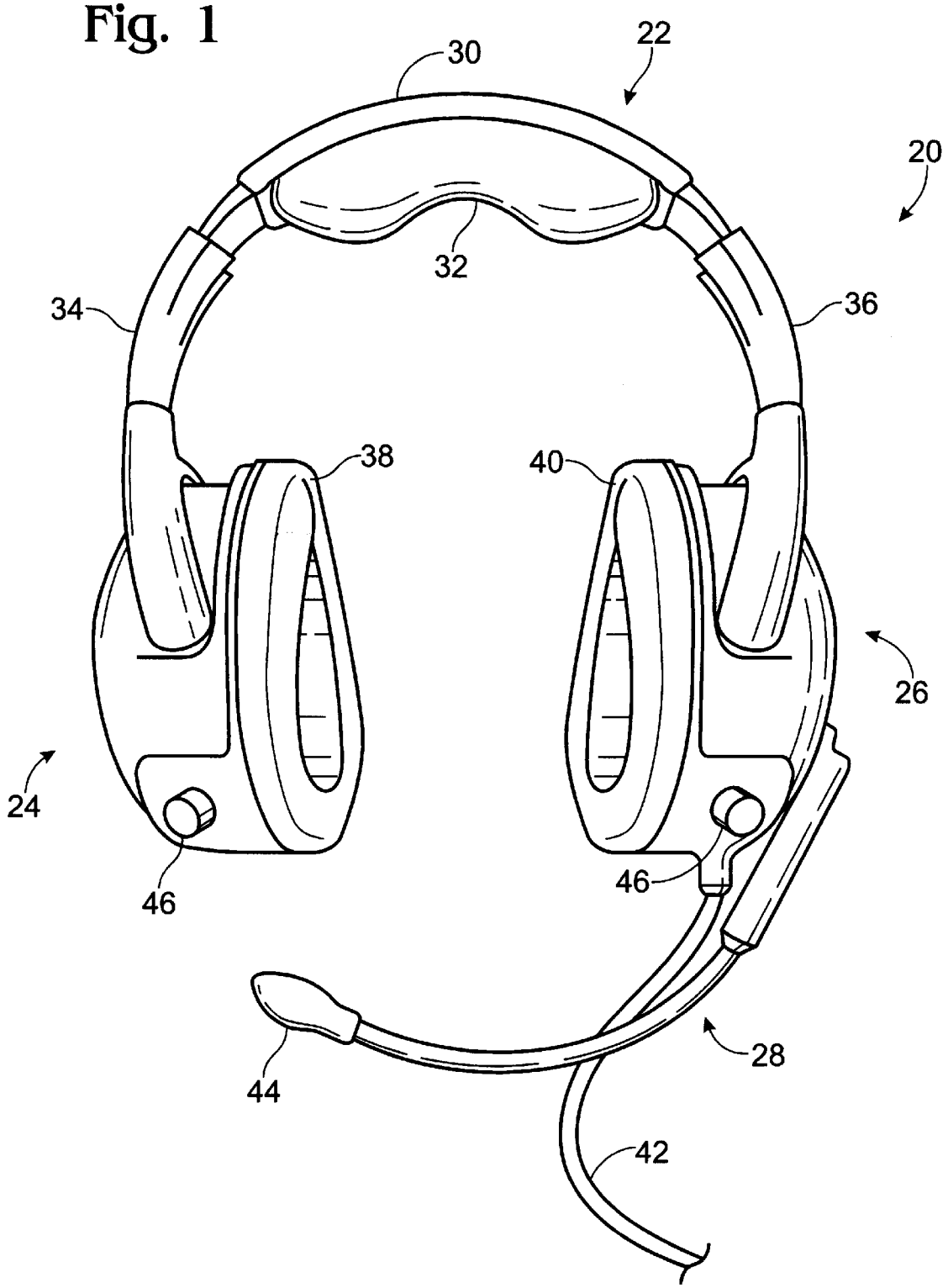
FIG. 1 is front elevation of a headset constructed according to the invention.

Referring now to FIG. 1, a headset is shown generally at 20. Headset 20 includes a headband 22, spaced apart ear cups 24, 26, and a microphone boom 28.

Headband 22 includes a head element 30, having a head cushion 32 carried on the bottom side thereof. A pair of ear cup supports 34, 36 is moveable on head element 30, to provide adjustment for ear cups 24, 26, respectively. Each ear cup 24, 26, is pivotally mounted on its respective ear cup support 34, 36, and includes a ear cup, or acoustic, seal 38, 40. A cord 42 extends from ear cup 26 and provides an electrical connection to acoustic transducers (not shown) mounted in ear cups 24, 26, and to a microphone pickup element carried in a microphone housing 44, located at one end of microphone boom 28. Volume control knobs 46 are located on each ear cup to control the volume of the acoustic transducers located in each ear cup.

Figure 2:
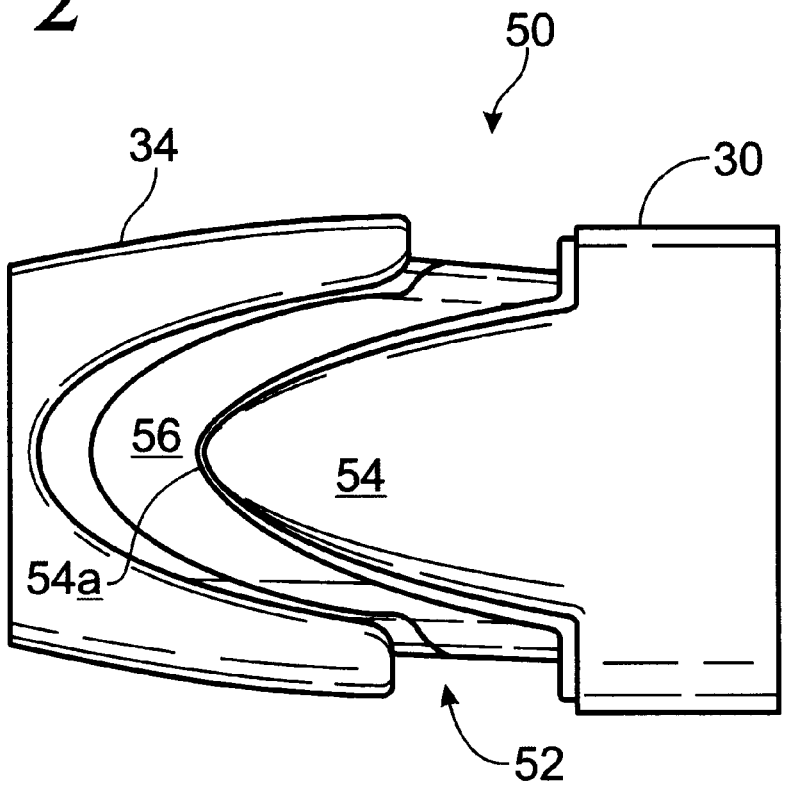
FIG. 2 is a top plan view of a near-constant pressure mechanism of the invention.
Figure 3:
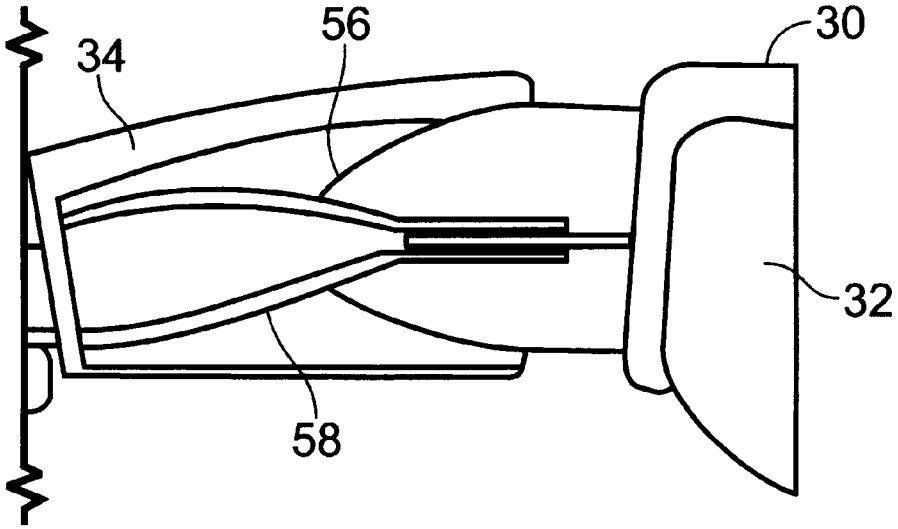
FIG. 3 is a bottom plan view of the near-constant pressure mechanism of FIG. 2.
Figure 4:
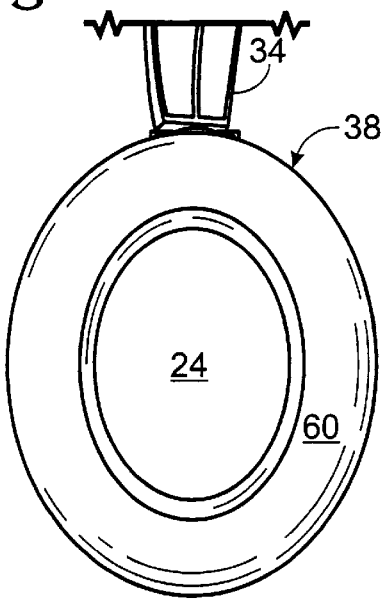
FIG. 4 is an interior view of an ear cup and ear seal of the invention.

Turning now to FIGS. 2 and 3, an object of headset 20 is to provide a near-constant lateral pressure between ear cup seals 38, 40, and a wearer's head. To this end, the structure surrounding a sliding joint 50, located between head element 30 and the ear cup supports, such as ear cup support 34, which allows an ear cup support to move into and out of a cavity (not shown) in head element 30. A tongue-like structure, shown generally at 52, includes a tongue 54, which extends outward and downward from either end of head element 30, over ear cup support 34, as shown in FIG. 2. Ear cup support 34 has a tongue receiver 56 that is conformal with tongue 54, and fully contacts tongue 54 when ear cup support 34 is fully inserted into head element 30. Tongue 54 contacts tongue receiver 56 only at tongue tip 54*a* as ear cup support 34 is withdrawn from head element 30. Referring to FIG. 3, the structure is shown on the underside of headband 22, and depicts the underside of the tongue receiver 56 of ear cup support 34. Also depicted is a stiffening structure 58, which is located on the underside of ear cup support 34. A cable channel runs along the underside of the ear cup supports, which have a generally inverted T-shaped configuration (not shown), wherein a cable extending between earcups 24, 26 is carried in the stem of the "T".

When an ear cup support is extended from head element 30, tongue 54 and tongue receiver 56 cooperate with the ear cup support to provide a near-constant bending moment on the ear cup support, which, in turn, provides the lateral force on the ear cup and the ear cup seal, as tongue 54 controls and limits relative upward and outward bending of ear cup support 34.

Turning now to FIGS. 4–12, the acoustic seal will be described in greater detail. The acoustic seal, and using ear cup seal 38 as an example, includes an inner cushion 62 of a dense, resilient foam, best seen in the cut-away portions of FIGS. 5 and 10. This structure allows the seal to conform to the wearer's head when in place, and to resume its original configuration after it is removed from the wearer's head. An outer covering 60 of the seal is formed, in the preferred embodiment, of 30 mil expanded vinyl, and is both vacuum formed and precut to the desired configuration, which will be described in more detail later herein. Covering 60 is coated, in the preferred embodiment, with a one mil thick layer of urethane ink, to provide additional environmental durability, i.e., to protect covering 60 from the effects of atmospheric and skin-carried contaminants. Interior filling 62 is formed of four-pound per cubic foot scythed urethane foam, formed in the desired shape and enclosed within covering 60, without over stuffing.

Ear cup seal 38 has an irregular shape in order to easily conform to a wearer's head. The seal has a thickness of between 0.85" and 0.65", and is thickest in the region in contact with the wearer's head about the lower margins of the wearer's ears and to the rear thereof. The thinnest portion of the ear cup seal is located in front of the wearer's ear, and adjacent to lower margin thereof, extending along the jaw line. This configuration provides the improved acoustic seal of the invention, which is in full contact with the wearer's head along the contours thereof, particularly along the jaw line and neck, which are areas subject to gaps with conventional ear seals. The configuration also provided an ear seal of minimal thickness.

Figure 5:
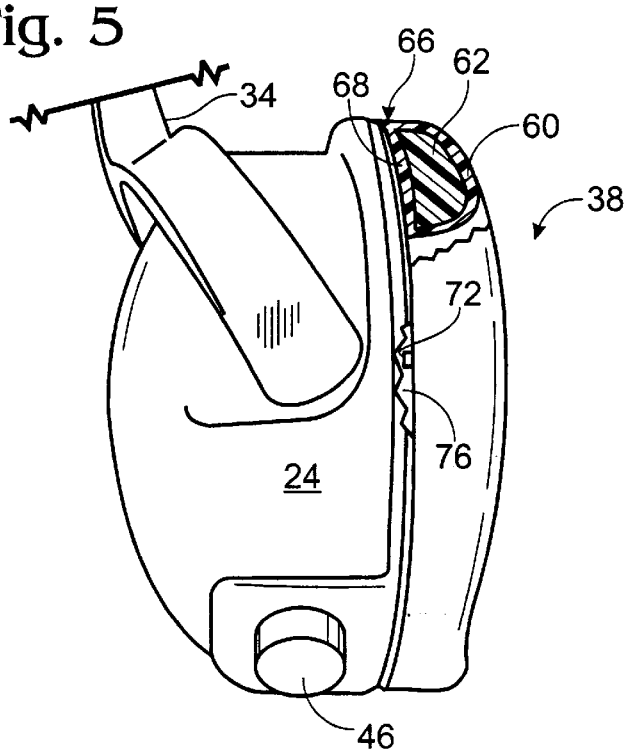
FIG. 5 is a front elevation of the ear cup and ear seal of FIG. 4, with portions broken away to show interior detail of an ear cup seal of the invention.
Figure 6:
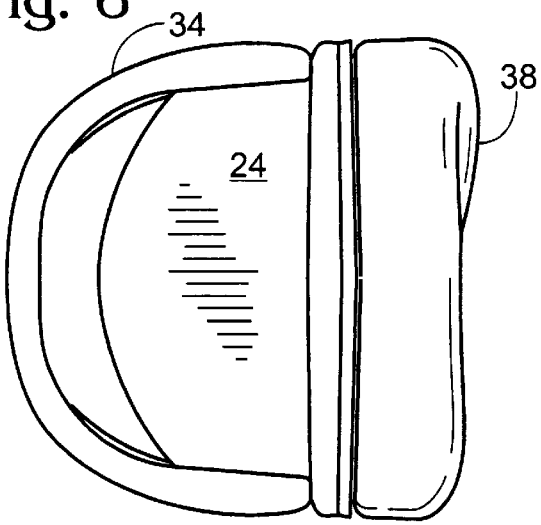
FIG. 6 is a top plan view of the ear cup and ear seal of FIG. 4.
Figure 7:
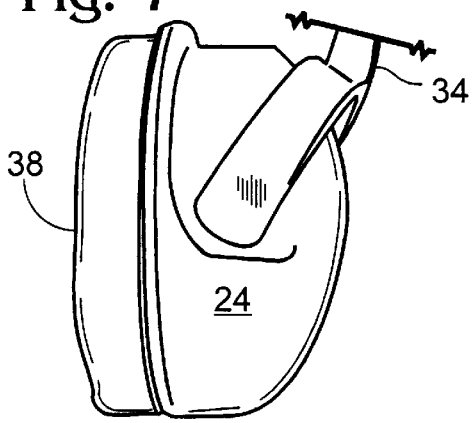
FIG. 7 is a rear elevation of the ear cup and ear seal of FIG. 4.
Figure 8:
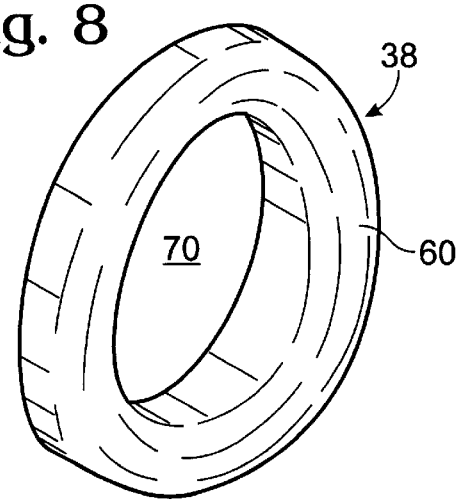
FIG. 8 is a perspective view of an ear cup seal of the invention.
Figure 10:
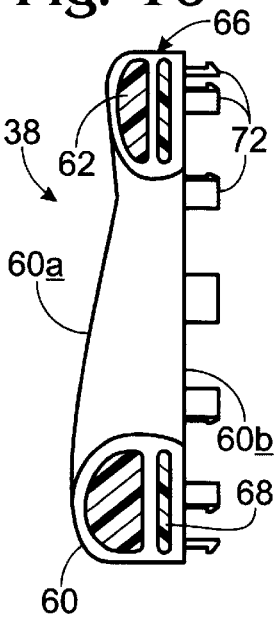
FIG. 10 is a left side elevation of the ear cup seal of FIG. 8, with portions broken away to show detail.
Figure 9:
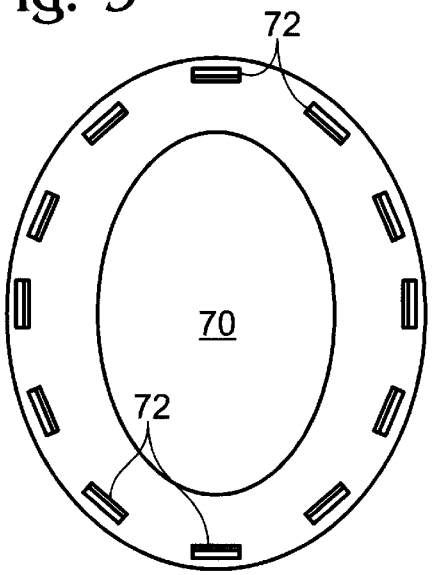
FIG. 9 is a front elevation of the ear cup seal of FIG. 8.
Figure 11:
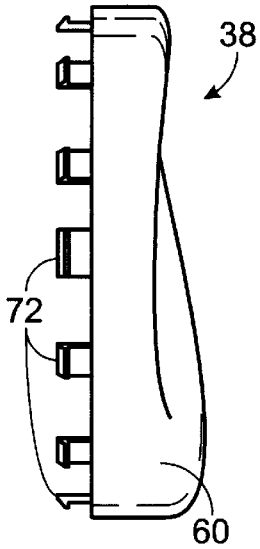
FIG. 11 is a right side elevation of the ear cup seal of FIG. 8.
Figure 12:
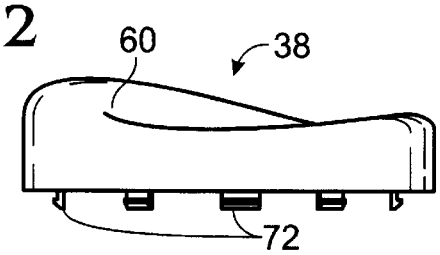
FIG. 12 is a bottom plan view of the ear cup seal of FIG. 8.
Figure 13:
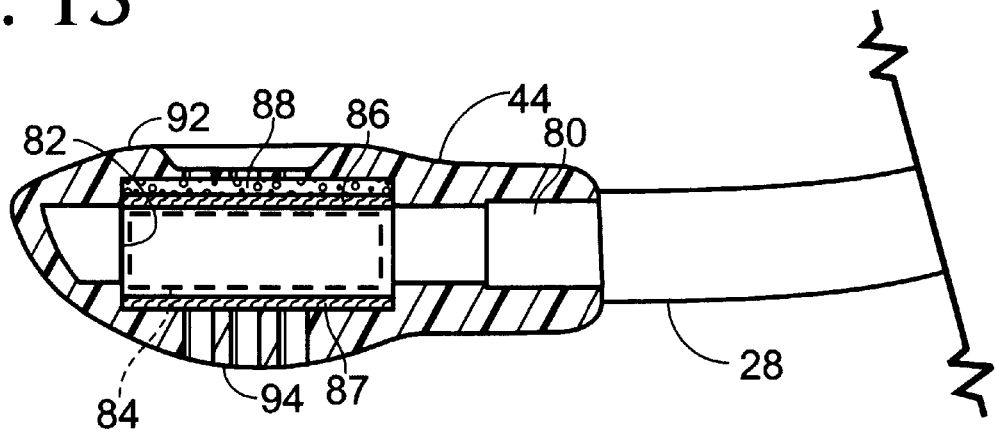
FIG. 13 is a top plan view of a microphone holder of the invention, with portions broken away to show detail.
Figure 14:
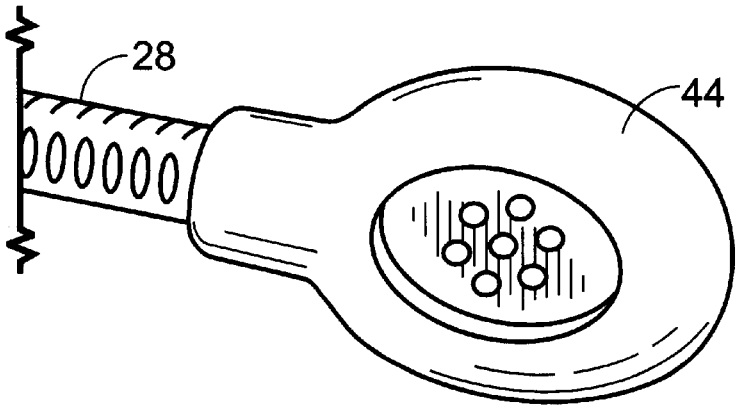
FIG. 14 is a rear elevation of the microphone holder of FIG. 13.
Figure 15:
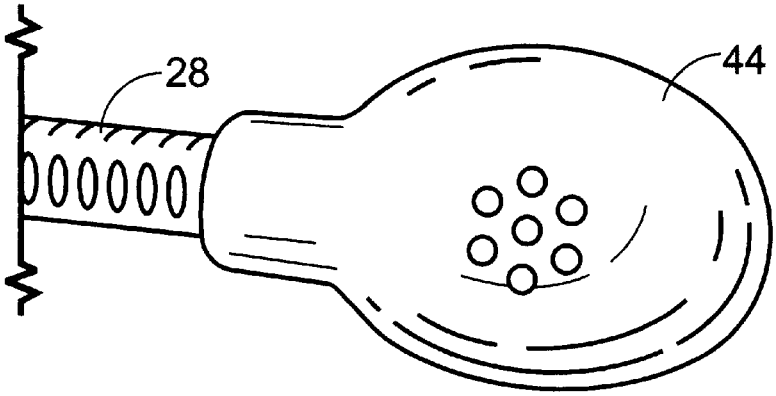
FIG. 15 is a front elevation of the microphone holder of FIG. 13.

Referring now specifically to FIGS. 5 and 10, a backing plate 66 is located within ear cup seal 38 to attach the seal to the ear cup. Backing plate 66 includes a flat annular ring 68 having a central orifice 70 therein. Ring 68 has a series of snap hook structures 72 protruding from the rear surface thereof, which cooperate with a groove 76 extending about the inner periphery of each ear cup, also referred to herein as an ear cup seal receiver, to hold the ear cup seal on the ear cup. As best shown in FIG. 10, covering 60 includes a formed portion 60*a* and a backing portion 60*b*. Backing portion 60*b* is precut from the vinyl material and has holes formed therein to allow passage of snap hook structures 72. Formed portion 60*a* is attached to backing portion 60*b*, in the preferred embodiment by RF welding, with backing plate 66 and inner cushion 62 sealed therein, and with snap hook structures 72 extending through holes formed in backing portion 60*b*.

Turning now to FIGS. 1 and 13–15, the microphone of the invention will be further described. Microphone boom 28 extends from left ear cup 26. The boom is a flexible material and is rotatable on a pivot on ear cup 26, so that it may be moved upward to a position over the wearer's head, or downward to an operable position in front of the wearer's mouth. Microphone housing 44 is attached to one end of boom 28. Housing 44 includes an endcap 80, which is received on the end of boom 28, and which has a cylindrical opening therein, forming an open cavity 82 therein. Cavity 82 encloses a microphone pickup element 84, of the bidirectional type. Felt discs 86, 87 are placed on the front and rear, respectively of pickup element 84. Discs 86, 87 protect element 84 from dust and any spray which may invade the interior of housing 44.

A foam buffer 88 is placed in cavity 82 on the side of microphone pickup element 84 facing the user. Buffer 88 is formed of urethane foam, and is approximately one-eight on an inch thick. Buffer 88 functions as a plosive sound absorbing mechanism, to absorb "puff" sounds associated with the plosive consonants, i.e., b, p, t, and numbers 2, 4 and 5.

A front housing element 92 and a read housing element 94 are secured to endcap 80. This arrangement provides a hard exterior for the microphone, in the form of housing 44, while the felt and foam layers provide a soft cushion for microphone pickup element 84 which reduces the amount of background noise that is picked up and transmitted through microphone element 84.

Although a preferred embodiment of the invention has been disclosed herein, it will be appreciated that futher variations and modification may be made thereto without departing from the scope thereof as defined in the appended claims.

We claim:

1. In an aircraft headset having a headset band, including a head element and a pair of ear cup supports slidably received in the head element, ear cups pivotally attached at one end of each ear cup support; and a microphone boom pivotally attached to one of the ear cups; an improved ear cup tensioning mechanism comprising:

a generally flat, parabolic-like shaped tongue extending laterally from each end of the headset band and a conformal tongue receiver located adjacent the other end of each ear cup support; wherein said tongue receiver is conformal with said tongue, and wherein said tongue and said tongue receiver are constructed and arranged to provide near-constant lateral pressure between the ear cups and a wearer's bead.

2. The improved ear cup tensioning mechanism of claim 1 wherein said tongue includes a narrowed tongue tip portion thereto, and wherein said tongue tip portion is in substantial point contact with said tongue receiver when an ear cup support withdrawn from the head element.

3. An aircraft headset having a headset band, including a bead element and a pair of ear cup supports slidably received in the head element, ear cups pivotally attached at one end of each ear cup support; and a microphone boom pivotally attached to one of the ear cups; comprising:

an ear cup tensioning mechanism including a generally flat, parabolic-like shaped tongue extending laterally from each end of the headset band and a conformal tongue receiver located adjacent the other end of each ear cup support; wherein said tongue receiver is conformal with said tongue, and wherein said tongue and said tongue receiver are constructed and arranged to provide near-constant lateral pressure between the ear cups and a wearer's head; and an ear cup seal having an outer seal covering formed of expanded vinyl;

an inner flexible layer formed of scythed urethane foam;

wherein said inner flexible layer has a memory which returns said inner flexible layer to its original configuration when pressure is released therefrom, and wherein said ear cup seal has a variable configuration having its thickest region adjacent the bottom of a wearer's ear and behind thereof, and having its thinnest region in front of a wearer's ear and ahead thereof.

4. The aircraft headset of claim 3 wherein said outer seal covering includes a formed portion and a backing portion, and wherein said inner flexible layer is sealed within the portions of said outer seal covering; and which further includes a backing plate sealed between said backing portion and said inner flexible layer.

5. The aircraft headset of claim 4 wherein said backing plate includes snap hook structures for securing said ear cup seal to the ear cup seal receiver.

6. The aircraft headset of claim 3 wherein said seal covering has a layer of urethane ink applied there over.

7. An aircraft headset having a headset band, including a head element and a pair of ear cup supports slidably received in the head element, ear cups pivotally attached at one end of each ear cup support; and a microphone boom pivotally attached to one of the ear cups; comprising:

an ear cup tensioning mechanism including a generally flat, parabolic-like shaped tongue extending laterally from each end of the headset band and a conformal tongue receiver located adjacent the other end of each ear cup support; wherein said tongue receiver is conformal with said tongue, and wherein said tongue and said tongue receiver are constructed and arranged to provide near-constant lateral pressure between the ear cups and a wearer's head; and a microphone housing including an endcap which is received on the end of the microphone boom, and which has a cylindrical opening therein, forming an open cavity;

a bi-directional microphone pickup element received in said cavity, wherein said pickup element includes a felt disc fixed on the front and rear sides thereof, and wherein a foam sound absorbing mechanism is located said cavity on the front side of said microphone pickup element; and a front housing element and a rear housing element secured to said endcap to form, with said endcap, a hard exterior for the microphone.

8. The aircraft headset of claim 7 wherein said foam buffer is formed of urethane foam, having a thickness of about one-eight on an inch thick.

* * * * *